US007741759B2

(12) United States Patent
Sugiyama et al.

(10) Patent No.: US 7,741,759 B2
(45) Date of Patent: Jun. 22, 2010

(54) ELECTRON TUBE AND METHOD FOR MANUFACTURING ELECTRON TUBE

(75) Inventors: Hiroyuki Sugiyama, Hamamatsu (JP); Keisuke Inoue, Hamamatsu (JP); Hitoshi Kishita, Hamamatsu (JP); Hideki Shimoi, Hamamatsu (JP); Hiroyuki Kyushima, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 177 days.

(21) Appl. No.: 11/922,007

(22) PCT Filed: Jun. 28, 2006

(86) PCT No.: PCT/JP2006/312902

§ 371 (c)(1),
(2), (4) Date: Dec. 12, 2007

(87) PCT Pub. No.: WO2007/020753

PCT Pub. Date: Feb. 22, 2007

(65) Prior Publication Data

US 2009/0236985 A1 Sep. 24, 2009

(30) Foreign Application Priority Data

Aug. 12, 2005 (JP) ..... 2005-234114

(51) Int. Cl.
*H01J 43/00* (2006.01)

(52) U.S. Cl. ..... 313/103 R; 313/103 CM; 313/532; 313/541; 313/542; 313/544; 250/207

(58) Field of Classification Search .. 313/532–105 CM, 313/541, 542, 544, 103 R, 103 CM; 250/207
See application file for complete search history.

(56) References Cited

U.S. PATENT DOCUMENTS

| | | | | |
|---|---|---|---|---|
| 5,264,693 | A | 11/1993 | Shimabukuro et al. | |
| 5,329,110 | A | 7/1994 | Shimabukuro et al. | |
| 5,504,386 | A * | 4/1996 | Kyushima et al. | 313/103 R |
| 5,568,013 | A * | 10/1996 | Then et al. | 313/532 |
| 7,049,747 | B1 | 5/2006 | Goodberlet et al. | |
| 7,067,397 | B1 * | 6/2006 | Chang-Chien et al. | 438/459 |
| 7,294,954 | B2 | 11/2007 | Syms | |

FOREIGN PATENT DOCUMENTS

| | | |
|---|---|---|
| JP | 2003-175500 | 6/2003 |
| JP | 2004-226632 | 8/2004 |

* cited by examiner

*Primary Examiner*—Nimeshkumar D. Patel
*Assistant Examiner*—Thomas A Hollweg
(74) *Attorney, Agent, or Firm*—Drinker Biddle & Reath LLP

(57) ABSTRACT

A photomultiplier tube 1 is an electron tube comprising an envelope 5 including a frame 3*b* having at least one end part formed with an opening and an upper substrate 2 airtightly joined to the opening, and a photocathode 6 contained within the envelope 5, the photocathode 6 emitting a photoelectron into the envelope 5 in response to light incident thereon from the outside; wherein multilayer metal films 10*b*, 10*a* each constituted by a metal film made of titanium, a metal film made of platinum, and a metal film made of gold laminated in this order are formed at the opening and the joint part between the upper substrate 2 and opening; and wherein the frame 3*b* and upper side substrate 2 are joined to each other by holding a joint layer 14 containing indium between the respective multilayer metal films 10*b*, 10*a*.

4 Claims, 6 Drawing Sheets

ELECTRON TUBE AND METHOD FOR MANUFACTURING ELECTRON TUBE

TECHNICAL FIELD

The present invention relates to an electron tube which generates a photoelectron in response to light incident thereon from the outside, and a method of making the same.

BACKGROUND ART

Electron tubes such as phototubes and photomultiplier tubes (PMT) have conventionally been known as photosensors. These electron tubes are constructed such that a photocathode which converts light into an electron and an anode are provided within a vacuum container. An example of such electron tubes is a photomultiplier tube in which a component having an inner face formed with a photocathode, a component formed with a photomultiplier part, and a component having an inner face formed with an anode are joined together (see the following Patent Document 1).

Meanwhile, as photosensors have recently been becoming versatile, the demand for reducing the size of electron tubes has been growing. On the other hand, a micropackage structure made by providing a silicon substrate and a glass sheet with respective bonding layers and joining the bonding layers to each other by a solder layer has been known as an example of microdevices having an optical function (see the following Patent Document 2).

Patent Document 1: U.S. Pat. No. 5,568,013

Patent Document 2: Japanese Patent Application Laid-Open No. 2003-175500

DISCLOSURE OF THE INVENTION

Problem to be Solved by the Invention

For reducing the size of an electron tube having a photocathode, however, there is a problem of how to keep the airtightness of the vacuum container while taking account of the corrosivity due to alkali metals and the like contained in the photocathode. Also, in the joining method in the above-mentioned micropackage structure, easily oxidizable metals such as chromium contained in the adhesive layers may be deposited on the surfaces of adhesive layers by heating processes before the joining and form oxide films, which deteriorate the bondability to the solder layer, whereby the airtightness has been hard to keep.

In view of such problems, it is an object of the present invention to provide an electron tube which can sufficiently keep the airtightness within a small-sized vacuum container and a method of making the same.

Means for Solving Problem

For solving the above-mentioned problems, the electron tube in accordance with the present invention is an electron tube comprising an envelope including a side tube having at least one end part formed with an opening and a joining member airtightly joined to the opening, and a photocathode contained within the envelope, the photocathode emitting a photoelectron into the envelope in response to light incident thereon from the outside; wherein a multilayer metal film constituted by a metal film made of titanium, a metal film made of platinum, and a metal film made of gold successively laminated toward a joining direction is formed in each of the opening and a joint part of the joining member with the opening; and wherein the side tube and the joining member are joined to each other by holding a joint material containing indium between the respective multilayer metal films.

In such an electron tube, a side tube and a joining member are joined to each other by holding a joint material containing indium between multilayer metal films each containing titanium, platinum, and gold in this order, so as to form an envelope, within which a photocathode emitting a photoelectron in response to light from the outside is provided. Such a structure prevents easily oxidizable metals from being deposited in the joint part and stably keeps the airtightness in the joint part of the envelope even when reducing the size of the envelope.

The method of making an electron tube in accordance with the present invention is a method of making an electron tube including a photocathode emitting a photocathode into an envelope in response to light incident thereon from the outside within the envelope, the method comprising the steps of preparing a side tube constituting a part of the envelope and having one end part formed with an opening; forming the opening with a metal film made of titanium, a metal film made of platinum, and a metal film made of gold in succession; preparing a joining member, to be joined to the opening, constituting a part of the envelope; forming a metal film made of titanium, a metal film made of platinum, and a metal film made of gold in succession at a joint part of the joining member with the opening; forming the photocathode within the side tube or within the joining member; and joining the opening of the side tube and the joining member to each other by holding a joint material containing indium therebetween.

In such a method of making an electron tube, while multilayer metal films each containing titanium, platinum, and gold in this order are formed at an opening of a side tube and a joining member, a photocathode is formed within the side tube or joining member, and then a joint material containing indium is held between the multilayer metal films, whereby the side tube and the joining member are joined to each other. Such a making method prevents easily oxidizable metals in the joint part from being deposited and stably keeps the airtightness in the joint part of the envelope even when reducing the size of the envelope.

EFFECT OF THE INVENTION

The electron tube and method of making the same in accordance with the present invention can sufficiently keep the airtightness within small-sized vacuum containers.

EXPLANATIONS OF NUMERALS

Figure 1:
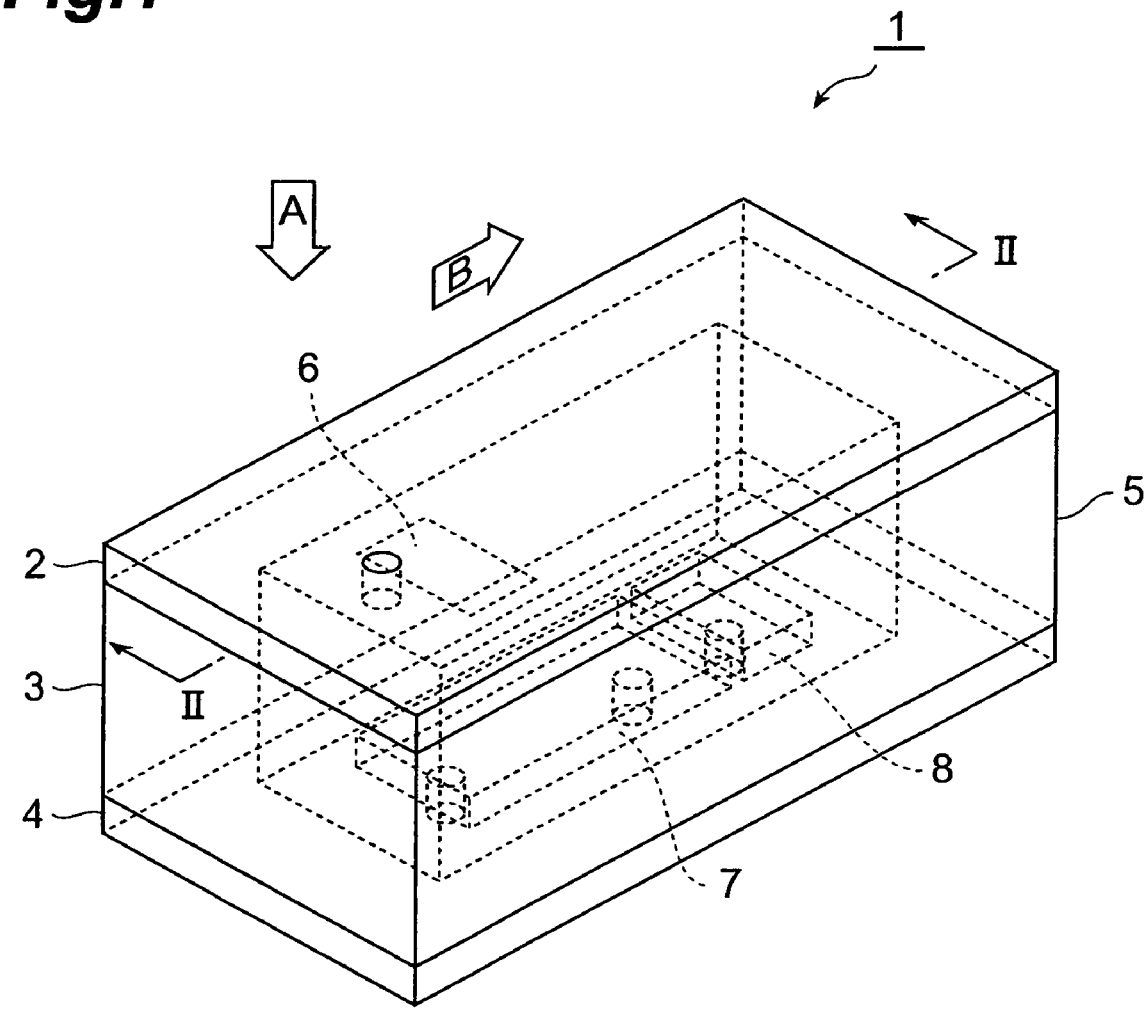
FIG. 1 A perspective view showing the structure of a photomultiplier tube which is an embodiment of the electron tube in accordance with the present invention.

1 . . . photomultiplier tube; 2 . . . upper substrate (joining member); 4 . . . lower substrate (joining member); 3*a*, 3*b* . . . frame; 5 . . . envelope; 6 . . . photocathode; 10*a*, 10*b* . . . multilayer metal film; 14 . . . joint layer; 15*a*, 15*b* . . . intermediate layer.

BEST MODES FOR CARRYING OUT THE INVENTION

In the following, preferred embodiments of the electron tube and method of making the same in accordance with the present invention will be explained in detail with reference to the drawings. In the explanation of the drawings, parts identical or equivalent to each other will be referred to with the same numerals while omitting their overlapping descriptions. Each drawing is made for the sake of explanation and depicted so as to emphasize parts to be explained in particular. Therefore, ratios in dimensions of members in the drawings do not always match those in practice.

FIG. 1 is a perspective view showing the structure of a photomultiplier tube 1 which is an embodiment of the electron tube in accordance with the present invention. As shown in this drawing, the photomultiplier tube 1 is a transmission type electron multiplier tube having an envelope 5 constituted by an upper substrate 2, a frame 3, and a lower substrate 4, and is constructed by accommodating a photocathode 6, an electron multiplier part 7, and an anode 8 within the envelope 5. This photomultiplier tube 1 is a photomultiplier tube in which the incident direction of light onto the photocathode 6 and the electron traveling direction in the electron multiplier part 7 intersect. Namely, when light is incident on the photomultiplier tube 1 from the direction indicated by arrow A, a photoelectron emitted from the photocathode 6 is incident on the electron multiplier part 7 and travels in the direction indicated by arrow B, thereby multiplying secondary electrons in a cascaded fashion. In the following, the individual constituents will be explained in detail.

Figure 2:
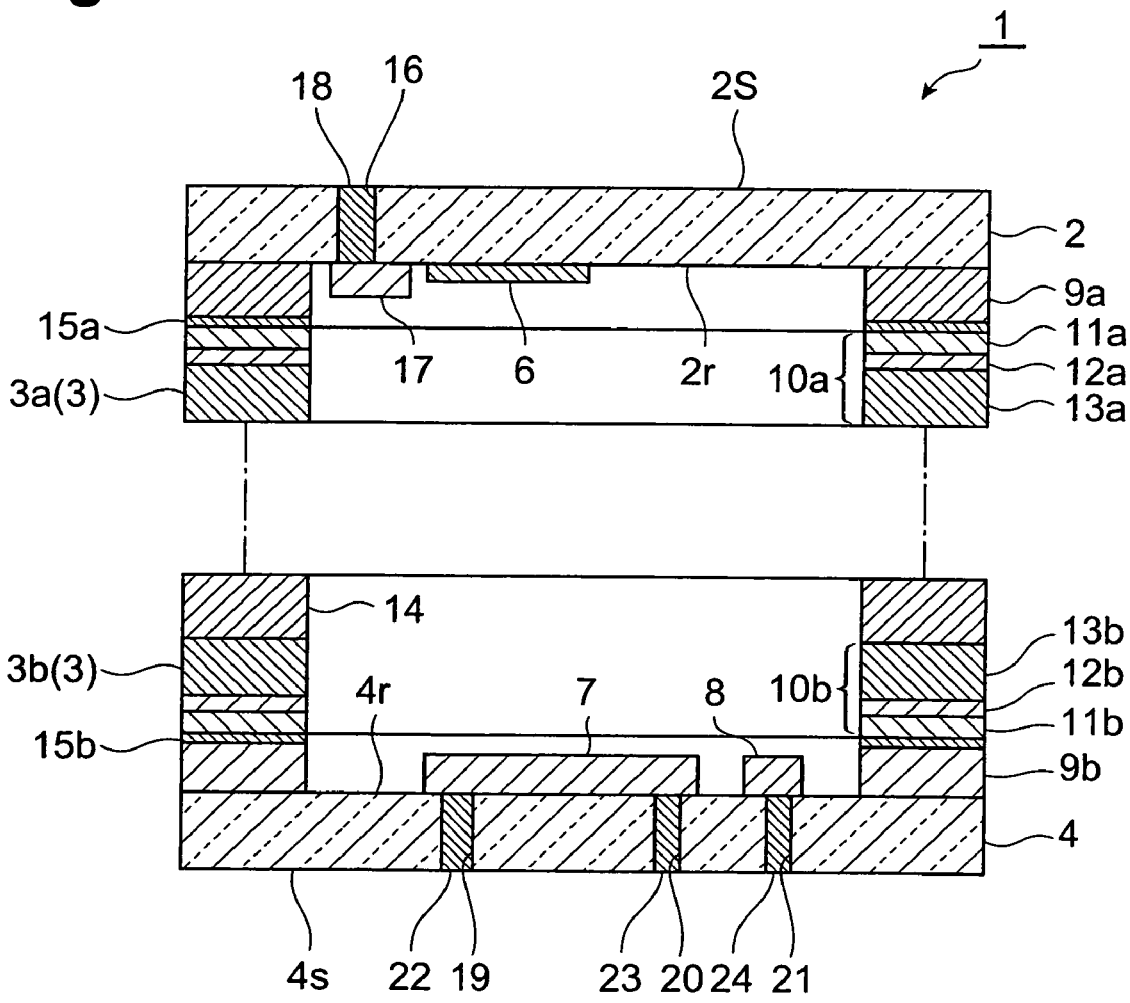
FIG. 2 An exploded sectional view of the photomultiplier tube taken along the line II-II of FIG. 1.

As shown in FIG. 2 which is an exploded sectional view of the photomultiplier tube 1 taken along the line II-II of FIG. 1, the upper substrate 2 and lower substrate 4 are rectangular flat sheets made of glass, while the frame 3 is constituted by two frame-like members, each having a hollow quadrangular prism form, which are joined together along the substrate surface. The frame-like members are connected to marginal parts of the upper substrate 2 and lower substrate 4 such that the four sides of each substrate are parallel to the four sides of each frame-like member.

Namely, the frame 3 is constituted by frames 3*a* and 3*b* as frame-like members. More specifically, the frame 3*a* connected to the upper substrate 2 has a frame body 9*a* made of silicon (Si) joined to the surface of the marginal part of the upper substrate 2 and a multilayer metal film 10*a* formed by laminating a metal film 11*a* made of titanium (Ti), a metal film 12*a* made of platinum (Pt), and a metal film 13*a* made of gold (Au) on the frame body 9*a* in this order toward the lower substrate 4. An intermediate layer 15*a* made of aluminum or silicon oxide ($SiO_2$) is provided between the frame body 9*a* and multilayer metal film 10*a*. Similarly, the frame 3*b* connected to the lower substrate 4 has a frame body 9*b* made of Si joined onto the surface of the marginal part of the lower substrate 4 and a multilayer metal film 10*b* formed by laminating a metal film 11*b* made of titanium, a metal film 12*b* made of platinum, and a metal film 13*b* made of gold on the frame body 9*b* in this order toward the upper substrate 2. An intermediate layer 15*b* made of aluminum or silicon oxide ($SiO_2$) is provided between the frame body 9*b* and multilayer metal film 10*b*. For example, the thicknesses of the metal films are such that the metal films 11*a*, 11*b* are 30 nm each, the metal films 12*a*, 12*b* are 20 nm each, and the metal films 13*a*, 13*b* are 1 μm each. Thus, the frames 3*a*, 3*b* have a structure forming respective openings defined by the end parts of the frame bodies 9*a*, 9*b* on the side opposite from the substrates 2, 4, while the openings are formed with the multilayer metal films 10*a*, 10*b*, respectively.

The frames 3*a* and 3*b* are joined together by holding a joint material containing indium (In) (including In, alloys of In and Sn, alloys of In and Ag, and the like, for example) between the multilayer metal films 10*a* and 10*b*, whereby the inside is kept airtight. Though a joint layer 14 made of a joint material is formed on the multilayer metal film 10*b* in FIG. 2, the joint layer may be formed on the multilayer metal film 10*a* as well. When one of the frame 3*a* joined to the upper substrate 2 and the frame 3*b* joined to the lower substrate 4 is a side tube, the other becomes a joining member in this embodiment. In such a structure, the upper substrate 2 including the frame 3*a* has a role as a joining member airtightly sealed to the opening of the frame 3*b* including the lower substrate 4 as a side tube, while the lower substrate 4 including the frame 3*b* has a role as a joining member airtightly sealed to the opening of the frame 3*a* including the upper substrate 2 as a side tube. Therefore, the multilayer metal films 10*a*, 10*b* are formed at the respective joint parts with the openings of the frames 3*b*, 3*a*, i.e., the marginal parts of the substrates 2, 4.

The frame 3 may be constituted by one member made of Si instead of two members of the frames 3*a* and 3*b*. In this case, the frame 3 as a side tube is directly joined to the upper substrate 2 and lower substrate 4 acing as joining members. In such a case of direct joint, a multilayer metal film and a joint layer may be used for joining one or both of the upper substrate 2 and lower substrate 4 to the frame 3. It will be preferred in particular if the upper substrate 2 having the photocathode 6 and the frame 3 are joined together by a joint by a multilayer metal film and a joint layer after joining the lower substrate 4 and frame 3 to each other by anodic bonding. When forming an Si layer 17 electrically connected to the photocathode 6, however, two members of the frames 3*a* and 3*b* are preferably provided as can be seen when taking account of steps of making the photomultiplier tube 1 which will be explained later.

The inner face 2*r* of the upper substrate 2 in such an envelope 5 is formed with a transmission type photocathode 6 containing an alkali metal emitting a photoelectron into the envelope 5 in response to light incident thereon from the outside. In this case, the upper substrate 2 functions as a transmission window which transmits therethrough toward the photocathode 6 light incident thereon from the outside. The photocathode 6 is formed closer to an end part in the longitudinal direction (lateral direction in FIG. 2) of the inner face 2*r* of the upper substrate 2 along the inner face 2*r*. The upper substrate 2 is formed with a hole 16 penetrating therethrough from a surface 2*s* to the inner face 2*r*, while the Si layer 17 electrically connected to the photocathode 6 is formed on the inner face 2*r* side of the hole 16. A photocathode terminal 18 is arranged in the hole 16, and is electrically connected to the photocathode 6 by electrically coming into contact with the Si layer 17.

On the inner face 4*r* of the lower substrate 4, the electron multiplier part 7 and anode 8 are formed along the inner face 4*r*. The electron multiplier part 7 has a plurality of wall parts erected so as to extend along each other in the longitudinal direction of the lower substrate 4, while a groove part is formed between the wall parts. The side walls and bottom parts of the wall parts are formed with secondary electron emissive surfaces made of a secondary electron emissive material. The electron multiplier part 7 is arranged at a position facing the photocathode 6 within the envelope 5. The anode 8 is provided at a position separated from the electron multiplier part 7. The lower substrate 4 is further provided with holes 19, 20, 21 penetrating therethrough from a surface 4*s* to the inner face 4*r*. A photocathode-side terminal 22, an anode-side terminal 23, and an anode terminal 24 are inserted in the holes 19, 20, and 21, respectively. Since the photocathode-side terminal 22 and anode-side terminal 23 are electrically in contact with both end parts of the electron multiplier part 7, respectively, a potential difference can be generated in the longitudinal direction of the lower substrate 4 by applying a predetermined voltage to the photocathode-side terminal 22 and anode-side terminal 23. Since the anode terminal 24 is electrically in contact with the anode 8, electrons having reached the anode 8 can be taken therefrom to the outside as a signal.

Operations of the photomultiplier tube 1 explained in the foregoing will now be explained. When light is incident on the photocathode 6 through the upper substrate 2, a photoelectron is emitted from the photocathode 6 toward the lower substrate 4. The emitted photoelectron reaches the electron multiplier part 7 facing the photocathode 6. Since a potential difference is generated in the longitudinal direction of the electron multiplier part 7 by applying a voltage to the photocathode-side terminal 22 and anode-side terminal 23, the photoelectron having arrived at the electron multiplier part 7 is directed toward the anode 8. Thereafter, the photoelectron having arrived at the electron multiplier part 7 is multiplied in a cascaded fashion while colliding with the side walls and bottom parts of the electron multiplier part 7, thereby reaching the anode 8 while generating secondary electrons. The generated secondary electrons are taken from the anode 8 to the outside through the anode terminal 24.

A method of making a photomultiplier tube in accordance with the present invention will now be explained with reference to FIGS. 3 and 4.

To begin with, a method of making the lower substrate 4 including the frame 3*b* will be explained with reference to FIG. 3. First, an Si substrate 25 shaped like a rectangular flat sheet is prepared, and two terminals 29*a*, 29*b* for the electron multiplier part 7 and a terminal 29*c* for the anode 8 are formed on the surface of the Si substrate 25 by patterning aluminum. Thereafter, depressions 26 are processed by reactive ion etching (RIE) such as to form rectangular parallelepiped islands 27, 28 on a surface including the terminals 29*a* and 29*b* and a surface including the terminal 29*c*, respectively (area (a) in FIG. 3).

Next, the lower substrate 4 made of glass having already provided with the holes 19, 20, 21 for inserting terminals is prepared, and the Si substrate 25 and lower substrate 4 are joined together by anodic bonding such as to hold the terminals 29*a*, 29*b*, 29*c* therebetween. Then, titanium, platinum, and gold are vapor-deposited in this order on the surface of the Si substrate 25, so as to produce the multilayer metal film 10*b* constituted by the metal films 11*b*, 12*b*, 13*b*, and the multilayer metal film 10*b* is formed at the marginal part on the surface of the Si substrate 25 by an etching process or liftoff process (area (b) in FIG. 3).

Figure 3:
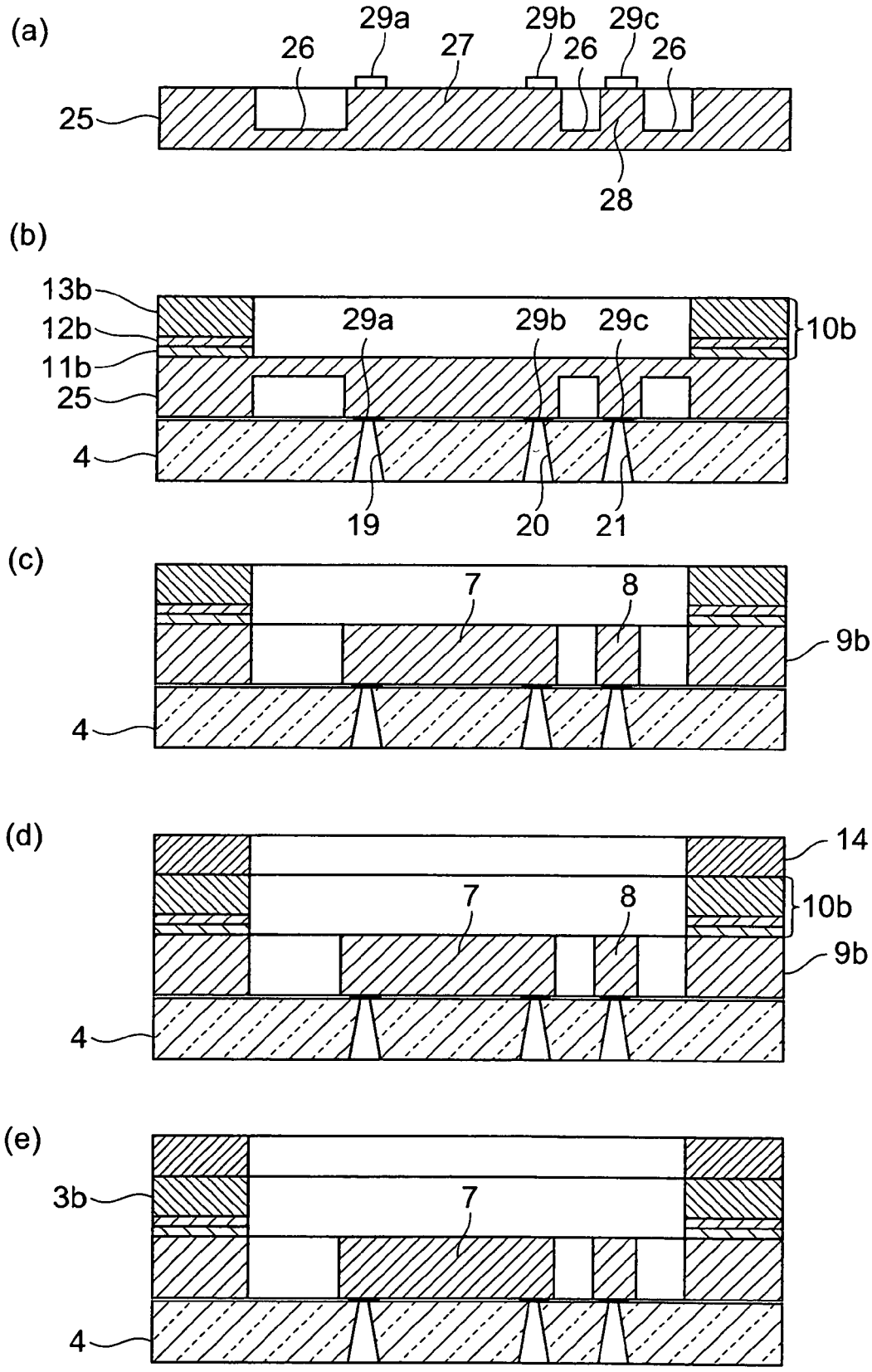
FIG. 3 A sectional view for explaining a method of making the photomultiplier tube of FIG. 1.

Thereafter, by an RIE process, the depressions 26 about the islands 27, 28 (see area (a) in FIG. 3) are penetrated through the Si substrate 25 to the surface thereof, so that the islands 27, 28 and the marginal part of the Si substrate 25 are formed as the electron multiplier part 7, anode 8, and frame body 9*b*, respectively (area (c) in FIG. 3). The frame body 9*b* may thereafter be treated at a high temperature for degassing thereof. In this case, depending on the processing temperature, the multilayer metal film 10*b* may become hard to keep. It will therefore be preferred if an intermediate layer made of aluminum or silicon oxide ($SiO_2$) is provided between the surface of the Si substrate 25 and the multilayer metal film 10*b* when forming the multilayer metal film 10*b*.

After forming the electron multiplier part 7, anode 8, and frame body 9*b*, the joint layer 14 to join with the opening of the upper substrate 2 including the frame 3*a* is vapor-deposited through a mask onto a surface of the metal film 10*b* acting as a joint part (area (d) in FIG. 3). Here, a material containing In such as In, an alloy of In and Sn, or an alloy of In and Ag is used as the joint layer 14. The joint layer 14 may also be formed by printing a metal paste containing the above-mentioned joint material and then removing the binder contained in the metal paste by heating.

After forming the joint layer 14, Sb, MgO, or the like is vapor-deposited through a mask onto the side walls and bottom parts of the wall parts of the electron multiplier part 7, and then an alkali metal is introduced, so as to form a secondary electron emissive surface (area (e) in FIG. 3). The foregoing steps prepare the frame 3*b* that forms a part of the envelope 5 and has one end part joined to the lower substrate 4 and the other end part formed with an opening.

Moving on to FIG. 4, a method of making the upper substrate 2 including the frame 3*a* will be explained.

First, an Si substrate 30 shaped like a rectangular flat sheet is prepared, and a terminal 33 for the photocathode 6 is formed on the surface of the Si substrate 30 by patterning aluminum. Thereafter, a depression 31 is processed by RIE such as to form a rectangular parallelepiped island 32 on the surface including the terminal 33 (area (a) in FIG. 4).

Next, the upper substrate 2 made of glass having already provided with the hole 16 for inserting a terminal is prepared, and the Si substrate 30 and upper substrate 2 are joined to each other by anodic bonding such as to hold the terminal 33 therebetween. Then, titanium, platinum, and gold are vapor-deposited in this order on the surface of the Si substrate 30, so as to produce the multilayer metal film 10*a* constituted by the metal films 11*a*, 12*a*, 13*a*, and the multilayer metal film 10*a* is formed at the marginal part on the surface of the Si substrate 30 by an etching process or liftoff process (area (b) in FIG. 4).

Figure 4:
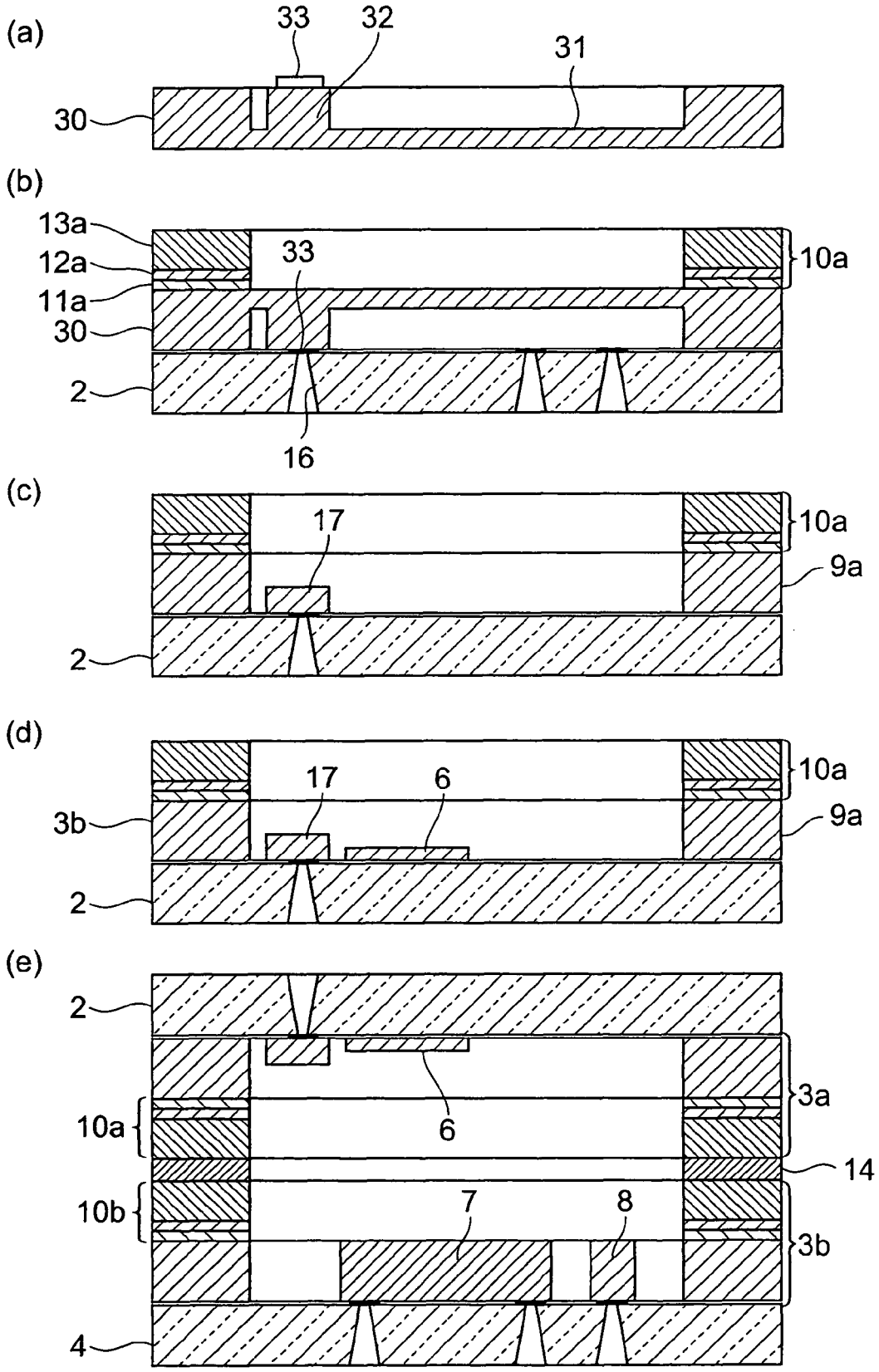
FIG. 4 A sectional view for explaining the method of making the photomultiplier tube of FIG. 1.

Thereafter, by an RIE process, the depression 31 about the island 32 (see area (a) in FIG. 4) is penetrated through the Si substrate 30 to the surface thereof, so that the island 32 and the marginal part of the Si substrate 30 are formed as the Si layer 17 and frame body 9*a*, respectively (area (c) in FIG. 4). The frame body 9*a* may thereafter be treated at a high temperature for degassing thereof. In this case, depending on the processing temperature, the multilayer metal film 10*a* may become hard to keep. It will therefore be preferred if an intermediate layer made of aluminum or silicon oxide ($SiO_2$) is provided between the surface of the Si substrate 30 and the multilayer metal film 10*a* when forming the multilayer metal film 10*a*.

After forming the Si layer 17 and frame body 9*b*, a photocathode material containing antimony (Sb) is vapor-deposited through a mask onto the upper substrate 2 on the center part side with respect to the Si layer 17. Thereafter, an alkali metal is introduced, so as to form the photocathode 6 (area (d) in FIG. 4). The foregoing steps prepare the frame 3*a* that forms a part of the envelope 5 and has one end part joined to the lower substrate 4 and the other end part formed with an opening.

Finally, while in a state where the ambient temperature is held at a temperature near the temperatures at which the above-mentioned photocathode 6 and secondary electron emissive surface are made, the frames 3*a* and 3*b* are joined together by aligning their openings with each other (area (e) in FIG. 4). This yields a state where the joint layer 14 is held between the multilayer metal films 10*a*, 10*b*, whereby the frames 3*a* and 3*b* are vacuum-sealed to each other when a joint material such as In is joined to the multilayer metal films 10*a*, 10*b*.

In the photomultiplier tube 1 explained in the foregoing, the frames (side tubes) 3*a*, 3*b* are joined to their corresponding substrates (joining members) 4, 2 by holding a joint material containing indium between the multilayer metal films 10*a*, 10*b* each containing titanium, platinum, and gold in this order, so as to construct the envelope 5, within which the photocathode 6 emitting a photoelectron in response to light from the outside is provided. Such a structure prevents metals such as Cr which are stabilized by oxidization in joint parts from being deposited, whereby the airtightness in the joint parts of the envelope 5 is stably kept even when reducing the size of the envelope 5. Since the corrosivity due to alkali metals which are components of the photocathode material becomes problematic in particular in the photomultiplier tube 1 that is an electron tube having the photocathode arranged therewithin, the structure holding the joint layer 14 between the multilayer metal films 10*a*, 10*b* is meaningful in terms of maintaining airtightness.

Also, when making the photomultiplier tube 1, easily oxidizable metals in the joint part between the frames 3*a* and 3*b* are not deposited, whereby the airtightness in the joint part of the envelope 5 after the making thereof is stably kept even when reducing the size of the envelope 5. The upper substrate 2 has its inner face formed with the photocathode 6, so that the ambient temperature can be kept in the same range from the making of the photocathode 6 to the joining of the envelope 5, and thus can be made efficiently.

Further, there is no need to assemble the inner structure in the making process, so that handling is easy, whereby the labor time is shorter. Since the envelope 5 and inner structure are constructed integrally, the size can be reduced easily. Since no individual parts exist in the inside, no electrical and mechanical joints are necessary.

Figure 5:
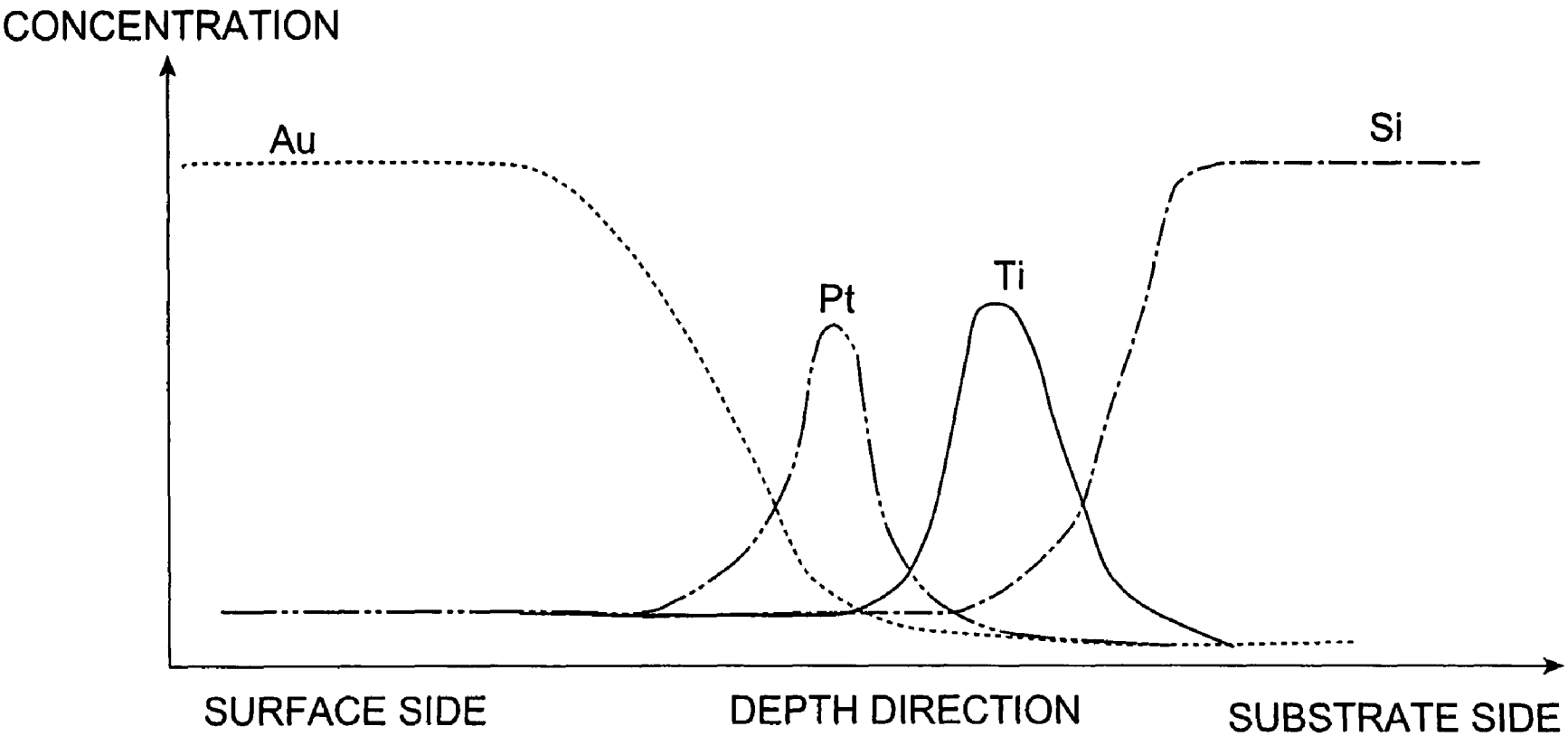
FIG. 5 A graph showing elemental analysis results in the laminating direction of a multilayer metal film in the photomultiplier tube of FIG. 1.
Figure 6:
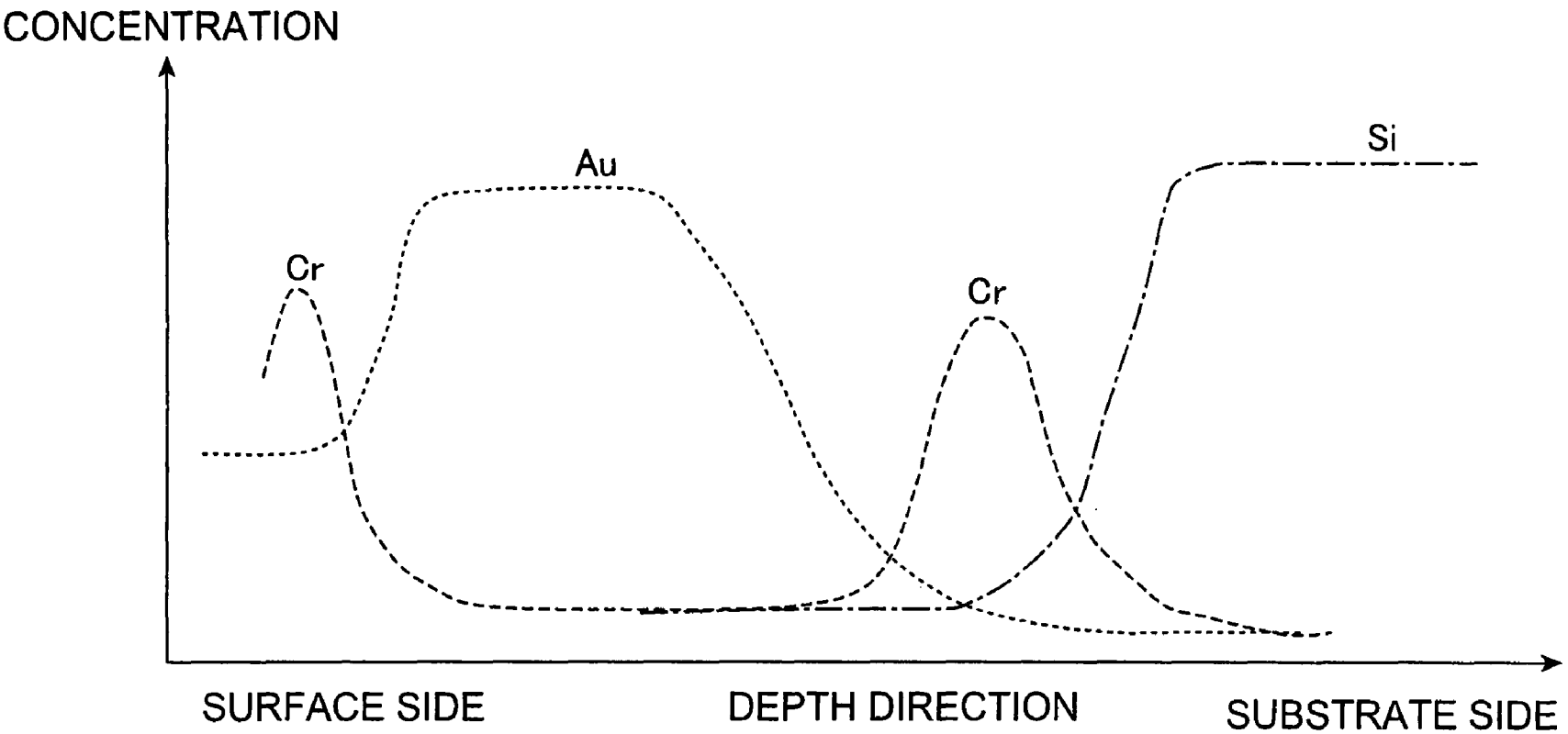
FIG. 6 A graph showing elemental analysis results in the laminating direction of a multilayer metal film in a comparative example of the present invention.

Here, FIG. 5 is a graph showing elemental analysis results in the laminating direction of the multilayer metal film 10*a* in the photomultiplier tube 1, while FIG. 6 is a graph showing elemental analysis results in the laminating direction of a multilayer metal film in a photomultiplier tube which is a comparative example using a film laminating chromium (Cr) and gold (Au) in this order as the multilayer metal film. The elemental analyses were performed with an Auger electron spectrometer (AES). As shown in these charts, it can be seen in the comparative example that Cr is deposited on the surface side of the multilayer metal film, so that air leak is easy to occur in the envelope. In the photomultiplier tube 1 in accordance with this embodiment, by contrast, metals other than Au are prevented from being deposited on the surface of the multilayer metal film 10*a*, whereby the airtightness of the envelope is effectively maintained.

Table 1 also shows yields in Examples 1 and 2 of the present invention and Comparative Examples 1 to 5. These yields were determined according to whether or not the active state of the photocathode was kept after the making process.

TABLE 1

| | UPPER SUBSTRATE MATERIAL | UPPER MULTILAYER METAL FILM | JOINT MATERIAL | LOWER MULTILAYER METAL FILM | LOWER SUBSTRATE MATERIAL | YIELD |
|---|---|---|---|---|---|---|
| EXAMPLE 1 | GLASS | Ti(30), Pt(20), Au(1000) | InSn SHEET | Ti(30), Pt(20), Au(1000) | GLASS | 6/6 |
| EXAMPLE 2 | GLASS | Ti(30), Pt(20), Au(1000) | InSn SHEET | Ti(30), Pt(20), Au(1000) | SILICON | 4/4 |
| COMPARATIVE EXAMPLE 1 | GLASS | Cr(50), Ni(500), Cu(1000), In(20) | InSn SHEET | | KOVAR | 4/19 |
| COMPARATIVE EXAMPLE 2 | GLASS | Cr(50), Ni(500), Cu(1000), In(20) | InSn SHEET | Cr(50), Ni(500), Cu(1000), In(20) | GLASS | 0/5 |
| COMPARATIVE EXAMPLE 3 | GLASS | Cr(20), Au(200) | InSn SHEET | Cr(20), Au(200) | GLASS | 0/1 |
| COMPARATIVE EXAMPLE 4 | GLASS | Cr(20), Au(200) | In | Cr(50), Ni(500) | GLASS | 0/1 |
| COMPARATIVE EXAMPLE 5 | GLASS | Cr(20), Au(200) | In | Cr(20), Au(200) | GLASS | 0/3 |

Here, Example 1 is an example of the case using an InSn sheet material as a joint material in the photomultiplier tube 1, while Example 2 is an example of the case in which the lower substrate 4 is made of Si, unlike Example 1 in which the lower substrate 4 is glass. Comparative Examples 1 to 5 are examples replacing the material of the multilayer metal film in the photomultiplier tube 1 with other materials. The composition of each multilayer metal film shown in Table 1 indicates that the multilayer metal film is formed on the upper or lower substrate in the described order, while the insides of parentheses after symbols of elements refer to their thicknesses (nm). In Comparative Examples 4 and 5, In was vapor-deposited on the lower multilayer metal film, so as to form a joint layer having a thickness of 10 μm.

These results show that the yield is 100% and very high in Examples 1 and 2 in which the multilayer metal film was formed in the order of Ti, Pt, and Au. By contrast, the yield drops to about 0% to 21% in Comparative Examples 1 to 5 which contain Cr, Ni, Cu, and the like and were formed in orders different from the above-mentioned order. This has clarified that the structure containing Cr in the multilayer metal film is not suitable for vacuum sealing.

Preferably, the joining member has its inner face formed with a photocathode. This is because, when the photocathode is thus formed on the inner face of the joining member, the ambient temperature can be kept in the same range from the making of the photocathode to the joining of the envelope, which enables efficient manufacture.

It will also be preferred if the photocathode contains an alkali metal. This also secures the sensitivity of the photocathode within the envelope in which the airtightness is maintained sufficiently, whereby the small-sized electron tube can be operated stably.

It will also be preferred if intermediate layers made of aluminum or silicon oxide are further formed between the opening and multilayer metal film and between the joint part and multilayer metal film, respectively. Providing such intermediate layers makes it possible to keep a favorable multilayer metal film structure even when high-temperature heat treatment for degassing each constituent member is performed in order to enhance the degree of vacuum within the electron tube.

The present invention is not limited to the embodiments mentioned above. For example, a reflection type photocathode may be used as the photocathode provided within the envelope 5. The photocathode may also be provided on the side of the lower substrate 4 provided with the electron multiplier part 7 and anode 8.

Though the electron tube of the above-mentioned embodiment is a photomultiplier tube, the present invention is also applicable to electron tubes such as phototubes having no electron multiplier part.

INDUSTRIAL APPLICABILITY

The present invention is aimed for use in an electron tube generating a photoelectron in response to light incident thereon from the outside and a method of making the same, and sufficiently keeps the airtightness within small-sized vacuum containers.

The invention claimed is:

1. An electron tube comprising:

an envelope including a tube having a side portion comprising silicon and having at least one end pan formed with an opening, and a joining member airtightly joined to the opening, the joining member comprising a joining part;

a photocathode positioned within the envelope, the photocathode emitting a photoelectron into the envelope in response to light incident onto the photocathode from outside the envelope; and a multiplier part positioned within the envelope and multiplying the photoelectron;

wherein the tube side portion includes a first multilayer metal film formed at the opening which comprises a first metal film made of titanium, a first metal film made of platinum, and a first metal film made of gold, and wherein the films of the first multilayer film are successively laminated such that the first metal film made of platinum is positioned closer to the opening than is the first metal film made of titanium, and the first metal film made of gold is positioned closer to the opening than is the first metal film made of platinum;

wherein the joining member includes a second multilayer metal film formed at the joining part which comprises a second metal film made of titanium, a second metal film made of platinum, and a second metal film made of gold, and wherein the films of the second multilayer film are successively laminated such that the second metal film made of platinum is positioned closer to the joining part than is the second metal film made of titanium, and the second metal film made of gold is positioned closer to the joining part than is the second metal film made of platinum;

wherein a joint material joins together the tube side portion and the joining member, the joint material comprising indium and being located between the first and second multilayer metal films;

wherein the multiplier part is separated from the tube side portion; and wherein a first intermediate layer comprising aluminum or silicon oxide is formed beneath the first multilayer metal film at the opening and a second intermediate layer comprising aluminum or silicon oxide is formed beneath the second multilayer metal film at the joining part.

2. An electron tube according to claim 1, wherein the joining member has an inner face on which is formed the photocathode.

3. An electron tube according to claim 1, wherein the photocathode contains an alkali metal.

4. A method of making an electron tube, including a photocathode positioned within an envelope and emitting a photoelectron into the envelope in response to light incident onto the photocathode from the outside the envelope, and a multiplier part positioned within the envelope and multiplying the photoelectron, the method comprising the steps of:

providing a tube having a side portion comprising silicon, constituting a part of the envelope, and having an end part formed with an opening;

forming, at the opening, and in succession, a first intermediate layer comprising aluminum or silicon oxide, a first metal film made of titanium, a first metal film made of platinum, and a first metal film made of gold;

providing a joining member, to be joined to the opening, constituting a part of the envelope;

forming, at a joining part of the joining member, and in succession, a second intermediate layer comprising aluminum or silicon oxide, a second metal film made of titanium, a second metal film made of platinum, and a second metal film made of gold;

forming the photocathode within the tube side portion or the joining member;

forming the multiplier part separated from the tube side portion within the tube side portion or within the joining member; and joining the opening of the tube side portion and the joining member to each other by using a joint material containing indium located between the opening and the joining member.

* * * * *